United States Patent [19]

Gutha

[11] 4,075,634

[45] Feb. 21, 1978

[54] PORTABLE ANTENNA ASSEMBLY FOR TELEVISION RECEIVER

[76] Inventor: Edward Gutha, 13930 Mapleridge, Detroit, Mich. 48205

[21] Appl. No.: 757,814

[22] Filed: Jan. 10, 1977

[51] Int. Cl.[2] ..... H01Q 7/00

[52] U.S. Cl. ..... 343/742; 343/869

[58] Field of Search ..... 343/741, 742, 869, 882

[56] References Cited

U.S. PATENT DOCUMENTS 2,817,838 12/1957 Kailey ..... 343/869

*Primary Examiner*—Eli Lieberman

*Attorney, Agent, or Firm*—Cullen, Settle, Sloman & Cantor

[57] ABSTRACT

The portable antenna assembly is for use indoors with a television receiver for receiving very high and ultra-high frequency television signal carrier waves radiated from transmitters located at varying distances and in different directions from the antenna assembly. The antenna assembly comprises a stand having a base member upon which is rotatably mounted a vertically extending antenna support member which carries first and second tubular antennas, each antenna being of generally rectangular configuration. The second antenna is located within the space subscribed by the first antenna and both antennas are located on the same side of the support member in generally the same vertical plane. The first and largest antenna is connected by a flexible cable to the very high frequency terminals of the television receiver and the second antenna is connected by a flexible cable to the ultra-high frequency terminals of the television receiver. With such a construction, the rotatable antenna support member carrying the antennas may be manually rotated on the base member and positioned to best receive the signals from a selected transmitter.

10 Claims, 5 Drawing Figures

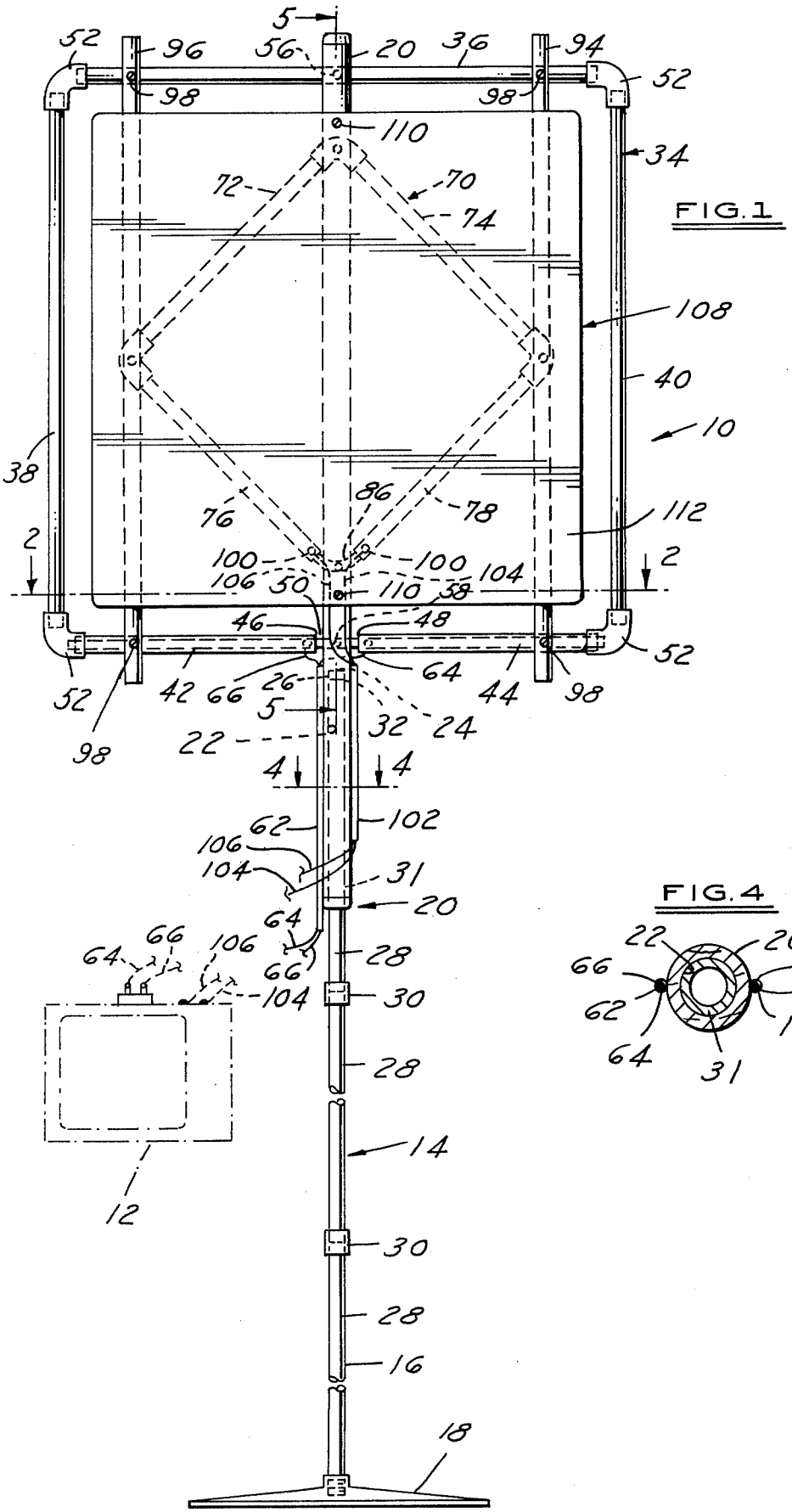
FIG. 1
FIG. 4
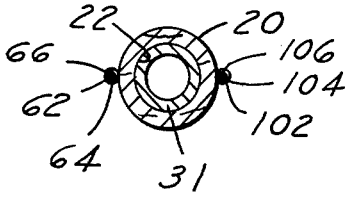

PORTABLE ANTENNA ASSEMBLY FOR TELEVISION RECEIVER

BACKGROUND OF THE PRESENT INVENTION

1. Field of the Invention

The portable antenna assembly is for use indoors with a conventional television receiver for receiving both very-high and ultra-high frequency television signals or signal carrier waves.

2. Description of the Prior Art

Portable television antenna assemblies now in use usually have a circular wire loop antenna for the reception of ultra-high frequencies and a pair of "rabbit ears" for the reception of very high frequencies. Each is selectively adjustable. The "rabbit ears" must be adjusted in a plurality of planes in order to obtain proper reception on any particular channel and in order to change from one channel to another. Specifically, it is necessary to rotate the antenna arms in vertical planes so that both arms of the antenna have the proper angle with respect to each other, as well as with respect to the horizontal. The arms themselves are telescopically extensible so that their length may be varied in accordance with the angular position of the arms and the channel which is being received. The ultra-high frequency antenna just described must be bent or the television set moved to receive favorable reception. However the use of such antennas attached directly to the television receiver do not lend themselves in many instances to favorable reception. In addition much time is required to obtain the proper antenna adjustment or setting resulting in inconvenience to the users particularly to the aged, sick or bed patients as well as the blind who listen to the audio portions of the programs.

Other types of portable television antennas for use indoors are known in the art including the following U.S. Pat. Nos. located during a novelty search in the U.S. Patent and Trademark Office: Brenner 1,554,328 of Sept. 22, 1925; Lamson 1,883,802 of Oct. 18, 1932; Atienza 2,064,585 of Dec. 15, 1936; Sjostrand 2,074,944 of Mar. 23, 1937; Pratt 2,093,158 of Sept. 14, 1937; Trowbridge 2,604,593 of July 22, 1952; Kailey 2,817,838 of Dec. 24, 1957; White 3,683,392 of Aug. 8, 1972; and Root 3,716,861 of Feb. 13, 1973.

SUMMARY OF THE INVENTION

The portable antenna assembly comprises a stand having a vertically extending antenna support member which is carried by and is rotatably mounted on the base member about a vertical axis. First and second tubular antennas, each being of generally rectangular configuration, are secured to the rotatable support member, with the second antenna being located within the space subscribed by the first antenna. Each of the antennas have a gap between a pair of closely adjacent but spaced apart end portions thereof. First and second flexible cables are secured respectively to the end portions of the first and second antennas and respectively to the very high frequency terminals and to the ultra-high frequency terminals of the television receiver. With such a construction the antenna support member may be manually rotated on the base member and positioned or directed to receive clear and strong signals from a selected transmitter.

A feature of the present invention is to provide a portable antenna assembly of the aforementioned type which can be located indoors adjacent the television receiver or near a window or wall which will provide maximum reception of the signals from the transmitters.

A further feature of the present invention is to provide a portable antenna assembly of the aforementioned type wherein a metal reflector plate is provided on the antenna support member spaced from and parallel to the antennas to block or screen from the second antenna signals from certain directions and to reflect to the selected antenna signals originating in other directions.

A still further feature of the present invention is to provide a portable antenna assembly of the aforementioned type wherein each antenna is made from a plurality of straight pieces of metal tubing which are arranged in the form of a rectangle, with adjacent ends of the pieces except at the gap being connected by a 90° metal elbow to form the rectangle.

Another feature of the present invention is to provide a portable antenna assembly of the aforementioned type wherein insulating elements are provided in the gaps of the antennas and are secured to the support member, with the end portions of each insulating element being received in the adjacent end portions of the antenna to rigidify the antenna.

Still another feature of the present invention is to provide a portable antenna assembly of the aforementioned type which is rugged in construction, efficient, and is economical to manufacture.

A further feature of the present invention is to provide a portable antenna assembly of the aforementioned type wherein the antenna support member may be quickly adjusted to any desired position throughout a range of 360° from the vertical axis thereof and thereafter retained in the selected position.

A still further feature of the present invention is to provide a portable antenna assembly of the aforementioned type wherein due to the construction thereof, the antenna assembly provides clearer television reception and eliminates in many instances common interference which occur when selecting a transmitter located at a considerable distance from the receiver.

BRIEF DESCRIPTION OF THE DRAWINGS

FIG. 1 is a front elevation of the portable antenna assembly;

FIG. 4 is a sectional view taken on the line 4—4 of FIG. 1; and

DETAILED DESCRIPTION OF A PREFERRED EMBODIMENT

Figure 2:
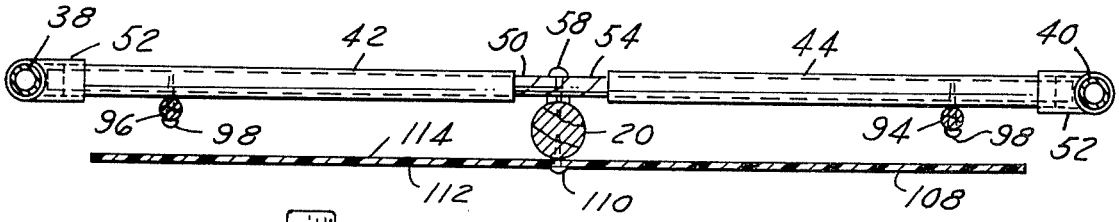
FIG. 2 is a sectional view taken on the line 2—2 of FIG. 1.
Figure 5:
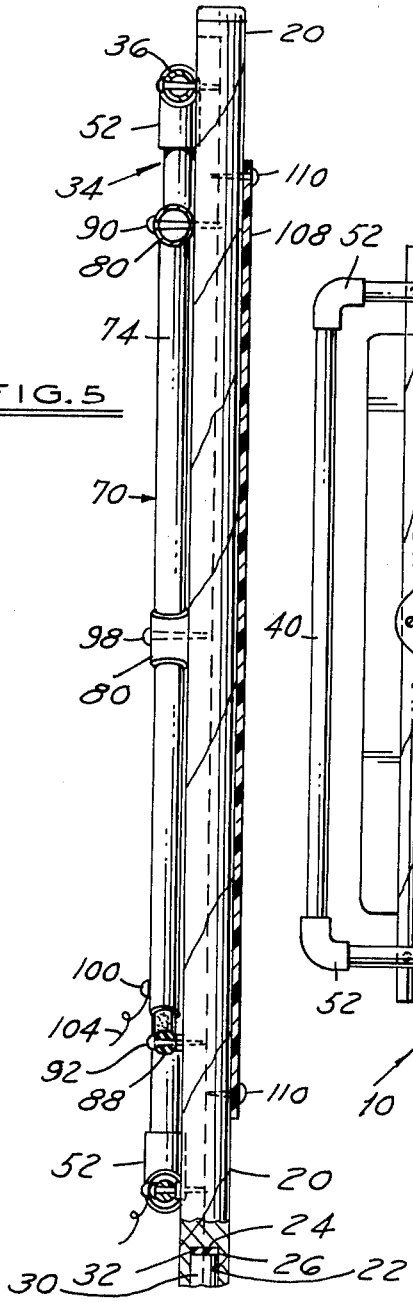
FIG. 5 is another sectional view taken on the line 5—5 of FIG. 1.

The portable antenna assembly 10 is designed to be used indoors alongside of or in close proximity to a commercial type of television receiver diagrammatically illustrated in FIG. 1 and designated by the numeral 12. Such television receivers are used primarily in homes. The portable antenna assembly 10 is connected by a pair of flexible cords of any desired length to the television receiver 12 which may, as an example, be located near a window, wall or other place in order to receive the best reception of the signals from the television transmitters. The antenna assembly 10 receives very-high and ultra-high frequency television signal carrier waves radiated from transmitters located at varying distances and in different directions from the antenna assembly 10.

The portable antenna assembly 10 is of light weight construction and may be readily moved or transported from one location to another depending on the choice or selection of the owner or user. The antenna assembly 10 comprises a stand 14 having a generally vertically extending stationary base member 16 provided with the floor engaging base 18 of approximately 9½ inches in diameter and a vertically extending antenna support member 20 of generally cylindrical configuration which is mounted on and is rotatably carried by the base member 16. The lower portion of the antenna support member 20 is provided with a generally cylindrical bore 22 which faces downwardly. The bore 22 is defined by the side walls of the tubular support member 20 and by the internal abutment or surface 24 against which is positioned a resilient or rubber insert member 26.

The stationary base member 16 consists of one or more cylindrical elements 28 (three being shown) which are vertically aligned and connected by threaded coupling members 30 as indicated in FIG. 1. The lower cylindrical element is threadedly connected to the base 18 as shown in FIG. 1. The end of the upper element 28 of base member 28 of base member 16 terminates in a generally cylindrical bearing portion 31 which is received in the bore 22 of the antenna support member 20. The cylindrical bearing portion 31 has a top surface 32 which engages the resilient insert 26. The resilient or rubber insert 26 serves as a brake and prevents the antenna support member 20 from swinging once moved to the selected position. As an alternative, the resilient insert 26 may be secured directly to the top surface 32 of the cylindrical bearing portion 31.

Figure 3:
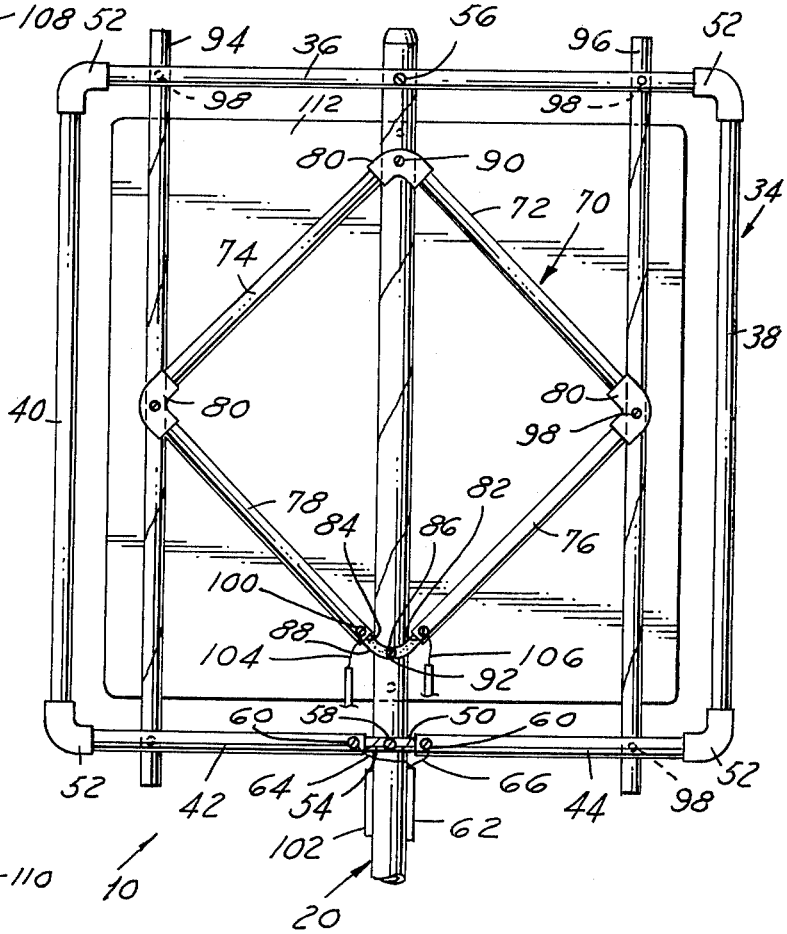
FIG. 3 is a fragmentary back view of the portable antenna assembly.

The antenna support member 20 has fixedly secured thereto a first tubular antenna 34 which is illustrated in FIGS. 1 and 3 to be of generally rectangular configuration. The antenna 34 is located in a vertical plane. The antenna 34 is made from five straight pieces of metal tubing which are interconnected by four 90° elbows. The antenna 34 comprises an upper generally horizontal tubular member 36, a pair of vertically extending and spaced apart vertical tubular members 38, 40 and a pair of horizontally aligned tubular members 42, 44 having their inner ends 46, 48 respectively spaced apart to form a gap 50. The members 36, 38, 40, 42 and 44 just described are arranged in an end by end relationship in the form of a rectangle as shown in FIGS. 1 and 3, with the adjacent ends thereof being connected by 90° elbows 52 except the ends 46, 48 adjacent the gap 50.

As an example, the antenna 34 is made from copper tubing and copper elbows. The members 36, 38 and 40 are each 16.5 inches in length and of ½ inch diameter. The other members 42 and 44 are each 7.25 inches in length and of ½ inch diameter. The four elbows 52 are ½ inch in size. The copper tubing or members are soldered to the elbows. The gap 50 is about two inches in length. A rubber or non-conducting or insulating insert or member 54 spans the gap 50 and has end portions or plugs which are tightly received in the adjacent ends 46, 48 of tubular members 42, 44. The antenna 34 is mounted at one side of and is secured to the antenna support member 20 by means of screws or other fastening elements 56, 58 which extend through the tubular member 36 and through the insert 54 respectively as shown in FIG. 3.

The opposite ends of members 42, 44 are provided with terminals or posts 60. A flexible cord 62 having a pair of wires 64, 66 is used to connect the receiver 12 to the antenna 34. Wire 64 is connected on one end to terminal 60 and on the other end to a terminal provided by one of the "rabbit ears" on the receiver 12, while wire 66 is connected on one end to the other antenna terminal 60 and on the other end to the other "rabbit ear" on the receiver 12 as generally indicated in FIG. 1. The "rabbit ears" are not extended but are housed or located in the housing of the receiver 12. The antenna 34 connected in the manner just described is designed to receive very-high frequency signal carrier waves. The cord 62 is flexible and of sufficient length to permit the antenna assembly 10 to be moved and the antenna support member 20 to be rotated throughout 360° without excessive wrapping of the cords around the stand 14.

On the same side of the antenna support member 20 as antenna 34 is mounted a second antenna 70 which is designed to receive ultra-high frequency signal carrier waves. The second antenna 70 is also of tubular construction and is of generally rectangular configuration as shown in FIGS. 1 and 3. The second antenna 70 is mounted in the same vertical plane as the first antenna 34 and is located within the space subscribed or formed by the first antenna 34.

The antenna 70 is made from four straight pieces of metal tubing which are interconnected by three 90° elbows. Antenna 70 has a pair of upper tubular members 72, 74 of equal length and a pair of lower tubular members 76, 78 of equal length but shorter in length than the upper members 72, 74. The members 72, 74, 76 and 78 just described are arranged in an end by end relationship in the form of a rectangle as shown in FIGS. 1 and 3, with the adjacent ends thereof being connected by 90° elbows 80 except the ends 82, 84 of members 76 and 78 respectively which are spaced apart to form a gap 86.

The antenna 70 is made from copper tubing and copper elbows. As an example, the members 72, 74 are each 8 inches in length and of ½ inch diameter. The other members 76, 78 are each about 7.25 inches in length and of ½ inch diameter. The three elbows 80 are ½ inch in size and are soldered to the elbows. The gap 86 is about 1.5 inches in length. A rubber or non-conducting or insulating insert or member 88 spans the gap 86 and has end portions or plugs extending upwardly which are tightly received in the adjacent ends 82, 84 of members 76, 78.

The antenna 70 is mounted on the tubular support member 20 with the insert 86 being the lowest point of the antenna 70 and with the elbow 80 directly opposite thereto being the high point of the antenna 70 as shown in FIG. 3. Screws or fastening elements 90 and 92 extend through the upper elbow 80 and through the insert 86 respectively into the support member 20.

A pair of elongated wooden dowels 94, 96 are spaced apart on opposite sides of the support member 20 as shown in FIGS. 1 and 3. The upper and lower end portions of the dowels 94, 96 are secured to the horizontal members 36, 42 and 44 of the first antenna 34, while intermediate portions of dowels 94, 96 are secured to the opposing pair of elbows 80 of the second antenna 70. Screws or other type fasteners 98 may be used to mount the antennas 34 and 70 to the dowels 94, 96 and to the support member 20.

The opposite ends 82, 84 of members 76, 78 are provided with terminals or posts 100. A flexible cord 102 having a pair of wires 104, 106 is used to connect the receiver 12 to the antenna assembly 20. Wires 104, 106 are each connected on one end to terminal 100 and on the other end to a ultra-high frequency binding post provided on the television receiver 12. The cord 102 like cord 62 is flexible and of sufficient length to permit the antenna assembly to be moved and the support member rotated throughout 360° without excessive wrapping of the cords around the stand 14.

A solid metal reflector plate 108 is mounted on the support member 20 by means of fasteners 110. It is made from aluminum and has a front surface 112 and a rear surface 114. It is mounted parallel to the antennas 34, 70 but spaced therefrom as shown in FIG. 2. The plate 108 is in the form of a square or rectangle and overlies or covers the ultra-high frequency antenna 70 as viewed in FIG. 1 so as to block or screen signals therefrom which strike the front surface 112 of plate 108. The plate 108 when the antenna assembly 10 is directed or positioned to receive signals, will permit the signals to strike the back surface 114 thereof so as to direct or reflect them to the appropriate antenna 34, 70 thus helping to provide a clearer and stronger signal at the receiver 12.

The front surface 112 of plate 108 may be provided with a decorative design pleasing to the eye.

It should be understood that the figures and the specific description thereof set forth in this application are for the purpose of illustrating the present invention and are not to be construed as limiting the present invention to the precise and detailed specific structure shown in the figures and specifically described hereinbefore. Rather, the invention is intended to include substantially equivalent constructions embodying the basic teachings and inventive concept of the present invention.

I claim:

1. A portable antenna assembly for use with a television receiver and for receiving very high and ultra-high frequency television signal carrier waves radiated from transmitters located at varying distances and in different directions from the antenna assembly comprising a stand having a vertically extending stationary base member and a vertically extending antenna support member which is carried by and rotatably mounted on said base member about a vertical axis, a first tubular antenna of generally rectangular configuration secured to said support member and located in a vertical plane, a second tubular antenna of generally rectangular configuration secured to said support member and located in a vertical plane, each of said first and second antennas having a gap between a pair of closely adjacent but spaced apart end portions thereof, a first cable consisting of two wires, each wire of said first cable being secured on one end thereof to an end portion of said first antenna and adapted to be secured on the other end to the very high frequency terminal of the television receiver, and a second cable consisting of two wires, each wire of said second cable being secured on one end to an end portion of said second antenna and adapted to be secured on the other end to the ultra-high frequency terminal of the television receiver, said antenna support member being adapted to be manually rotated on said base member so that it may be directed and positioned to best receive signals from a selected transmitter.

2. The portable antenna assembly defined in claim 1 wherein said second antenna is mounted on the same side of said antenna support member as said first antenna, said second antenna being located in the space subscribed by said first antenna.

3. The portable antenna assembly defined in claim 2 wherein a metal reflector plate is provided on the other side of said antenna support member and is secured thereto, said reflector plate being arranged parallel to but spaced from said first and second antennas.

4. The portable antenna assembly defined in claim 1 wherein each of said first and second antennas includes a plurality of straight pieces of metal tubing which are arranged in the form of a rectangle, with adjacent ends of the pieces except at said gap being connected by a 90° metal elbow to form the rectangle.

5. The portable antenna assembly defined in claim 4 wherein said metal tubing and elbows are made from copper.

6. The portable antenna assembly defined in claim 1 wherein a pair of insulating elements are inserted in the gaps of said first and second antennas, each of said insulating elements having ends which are received in the end portions of the corresponding antenna adjacent the gap, each of said insulating elements being secured to said antenna support member.

7. The portable antenna assembly defined in claim 6 wherein said insulating elements are made from rubber.

8. The portable antenna assembly defined in claim 2 wherein a pair of elongated and laterally spaced wood elements are mounted parallel to said antenna support member, with the end portions of said wood elements being secured to said first antenna and intermediate portions thereof secured to said second antenna.

9. The portable antenna assembly defined in claim 3 wherein said antenna support member is of cylindrical configuration and is provided with a downwardly opening bore, with the upper portion of said base member being of cylindrical configuration and received in said bore of said antenna support member.

10. The portable antenna assembly defined in claim 9 wherein a resilient insert is interposed in said bore, with the top surface of the upper portion of said base member contacting said resilient insert when said antenna support member is carried by said base member.

* * * * *